US008567991B2

(12) United States Patent
Krogman

(10) Patent No.: US 8,567,991 B2
(45) Date of Patent: Oct. 29, 2013

(54) LED INGROUND LIGHT

(71) Applicant: LSI Industries, Inc., Cincinnati, OH (US)

(72) Inventor: Mark J. Krogman, Southlake, TX (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 13/666,418

(22) Filed: Nov. 1, 2012

(65) Prior Publication Data

US 2013/0077305 A1 Mar. 28, 2013

Related U.S. Application Data

(60) Division of application No. 13/396,852, filed on Feb. 15, 2012, which is a continuation of application No. 12/245,116, filed on Oct. 3, 2008, now Pat. No. 8,152,334.

(60) Provisional application No. 61/095,159, filed on Sep. 8, 2008.

(51) Int. Cl.
*F21S 8/02* (2006.01)

(52) U.S. Cl.
USPC ..... 362/249.02; 362/249.1; 362/366; 362/421

(58) Field of Classification Search
USPC ..... 362/153, 153.1, 249.03, 249.07, 249.1, 362/273, 287, 289, 523, 524, 528, 545, 362/249.02, 366, 421, 428
See application file for complete search history.

(56) References Cited

U.S. PATENT DOCUMENTS

| | | | | | |
|---|---|---|---|---|---|
| 1,071,957 | A | | 9/1913 | Rawson | |
| 1,572,214 | A | | 2/1926 | McEwing et al. | |
| 1,739,641 | A | * | 12/1929 | Lessmann | 362/271 |
| 2,218,395 | A | * | 10/1940 | Hallbauer | 362/273 |
| 2,504,866 | A | | 4/1950 | Morse | |
| 2,619,582 | A | * | 11/1952 | Morse | 362/477 |
| 2,649,535 | A | | 8/1953 | Feder | |
| 2,800,575 | A | | 7/1957 | Robertson et al. | |
| 3,803,397 | A | * | 4/1974 | Dick | 362/496 |

(Continued)

FOREIGN PATENT DOCUMENTS

| | | |
|---|---|---|
| CN | 1954175 | 4/2007 |
| CN | 101078479 | 11/2007 |

(Continued)

OTHER PUBLICATIONS

PCT International Search Report for related PCT Application No. PCT/US2009/005326 (5 pages).

(Continued)

*Primary Examiner* — Ismael Negron
(74) *Attorney, Agent, or Firm* — McDermott Will & Emery LLP

(57) ABSTRACT

A lighting device having a support module supporting LEDs and having an outer perimeter defining a curved portion, and a housing with an inner surface having a curved portion configured to receive the curved portion of the support module to enable the disk to be aimed, while the curved portions of the disk and housing remain in contact. Optional adjustment means facilitate aiming of the support module without the need to open the sealed LED module.

15 Claims, 2 Drawing Sheets

(56) References Cited

U.S. PATENT DOCUMENTS

| | | | | |
|---|---|---|---|---|
| 4,360,859 | A | 11/1982 | Ziaylek | |
| 4,445,163 | A | 4/1984 | Ziaylek | |
| 4,499,528 | A | 2/1985 | Hawlitzki | |
| 4,574,337 | A | 3/1986 | Poppenheimer | |
| 4,623,956 | A * | 11/1986 | Conti | 362/148 |
| 5,041,950 | A | 8/1991 | Tyson | |
| 5,183,330 | A | 2/1993 | Rishel et al. | |
| 5,377,087 | A * | 12/1994 | Yoon | 362/275 |
| 5,404,297 | A | 4/1995 | Birk et al. | |
| 5,481,443 | A | 1/1996 | Wagner et al. | |
| 6,019,477 | A | 2/2000 | Wegrzyn et al. | |
| 6,152,590 | A | 11/2000 | Furst et al. | |
| 6,184,628 | B1 | 2/2001 | Ruthenberg | |
| 6,315,439 | B1 * | 11/2001 | Denley | 362/524 |
| 6,491,407 | B1 * | 12/2002 | Beadle | 362/153 |
| 6,607,292 | B2 * | 8/2003 | Gutierrez et al. | 362/371 |
| 6,974,231 | B2 * | 12/2005 | Burton | 362/273 |
| 7,220,029 | B2 * | 5/2007 | Bynum et al. | 362/490 |
| 7,357,525 | B2 | 4/2008 | Doyle | |
| 7,367,692 | B2 | 5/2008 | Maxik | |
| 7,434,968 | B2 | 10/2008 | Wu | |
| 7,562,995 | B1 * | 7/2009 | Levine | 362/197 |
| 7,614,769 | B2 | 11/2009 | Sell | |
| 7,690,816 | B2 | 4/2010 | Tyson et al. | |
| 7,744,259 | B2 | 6/2010 | Walczak et al. | |
| 7,950,832 | B2 | 5/2011 | Tanaka et al. | |
| 7,967,468 | B2 | 6/2011 | Levine | |
| 8,104,928 | B1 | 1/2012 | Horn | |
| 8,132,943 | B2 | 3/2012 | Wang | |
| 8,152,334 | B2 | 4/2012 | Krogman | |
| 8,172,436 | B2 | 5/2012 | Coleman | |
| 2002/0044443 | A1 | 4/2002 | Kira et al. | |
| 2003/0048632 | A1 | 3/2003 | Archer | |
| 2003/0161153 | A1 | 8/2003 | Patti | |
| 2006/0250789 | A1 | 11/2006 | Coushaine | |
| 2006/0262542 | A1 * | 11/2006 | Ibbitson et al. | 362/368 |
| 2008/0080190 | A1 | 4/2008 | Walczak et al. | |
| 2009/0034256 | A1 | 2/2009 | Engel | |
| 2009/0243495 | A1 | 10/2009 | Levine | |

FOREIGN PATENT DOCUMENTS

| | | | | |
|---|---|---|---|---|
| DE | 10 2006 001 289 | | 7/2007 | |
| EP | 1 657 486 | | 5/2006 | |
| EP | 1 860 369 | | 11/2007 | |
| EP | 1860369 | A1 * | 11/2007 | F21S 8/02 |
| JP | 2002260401 | | 9/2002 | |
| WO | WO 2005/075886 | | 8/2005 | |
| WO | WO 2007/113656 | | 10/2007 | |

OTHER PUBLICATIONS

PCT Written Opinion of the International Searching Authority for related PCT Application No. PCT/US2009/005326 (8 pages).

Response to the Written Opinion filed May 25, 2011 in Corresponding European Application No. 09792042.5.

Office Action received Feb. 20, 2013 from Corresponding Chinese Patent Application No. 200980134978.4.

Response dated Jan. 15, 2013 to Office Action dated Sep. 27, 2012 from Corresponding Canadian Patent Application No. 2735509.

Response dated Apr. 25, 2013 to Office Action dated Feb. 20, 2013 from Corresponding Chinese Patent Application No. 200980134978.4.

Response dated Jun. 18, 2013 to Office Action dated May 30, 2013 from Corresponding Canadian Patent Application No. 2,735.509.

Response dated Apr. 16, 2013 to Office Action dated Oct. 22, 2012 from Corresponding European Patent Application No. 09792042.5.

English Version of Office Action dated Jan. 7, 2013 from Corresponding Japanese Patent Application Number: 2011-526119.

English Version of Response dated Aug. 1, 2013 to Office Action dated Jan. 7, 2013 from Corresponding Japanese Patent Application Number: 2011-526119.

* cited by examiner

Section 1-1
Section 2-2
Section 3-3
Section 4-4
Section 5-5
200
212, 214
216
218
220
230
232
234
236
238
240
242
244
246
248
250
252
254
256
258
260
262

LED INGROUND LIGHT

RELATED APPLICATION

This application is a divisional application of U.S. patent application Ser. No. 13/396,852 filed Feb. 15, 2012, now pending, which is a continuation application of U.S. patent application Ser. No. 12/245,116 filed Oct. 3, 2008, now U.S. Pat. No. 8,152,334, which claims priority to U.S. Provisional Patent Application Ser. No. 61/095,159, filed 8 Sep. 2008, the entire content of which is incorporated herein by reference. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Light emitting diodes ("LEDs") are increasingly being used in applications where incandescent or fluorescent lights had previously being used. There are inground lights that are currently used for various lighting applications such as landscape and outdoor lighting. Typical previously existing inground lights, even those employing LEDs, are not optimized for use of LEDs and concomitant thermal management issue. For, example, these devices can suffer from thermal issues such as poor heat management and heat retention due to, e.g., poor conduction and/or convection. Among other things, such thermal management issues can lead to shortened light service life.

The issues of aiming inground light assemblies are typically addressed by opening the sealed light structure and then adjusting the base/lighting assembly manually with the unit open, e.g., to the elements and while being susceptible to dirt, water intrusion, etc.

What is desirable, therefore, are devices and techniques that address such limitations described for the prior art.

SUMMARY

Embodiments of the present disclosure address the shortcomings previously described for the prior art. Exemplary embodiments of the present disclosure include inground LED lighting units/assemblies that can be aimed by external adjustment devices/features/means without the need to open the sealed LED module. Heat from the LEDs and/or LED mounting assembly can be transferred to the outside air or internal heat conducting structures while the module is tilted, e.g., up to 15 degrees or more, from vertical. Use of materials (e.g., thermally conductive grease and/or bronze alloys) with high thermal conductivity can facilitate thermal management. The thermal dissipation/management afforded by the designs of embodiments according to the present disclosure can allow for an increase of the LED useful service life.

The sealing of the inground light unit can preclude/minimize the chance of an end user (e.g., service technician) from causing the unit to leak and thereby cause premature failure. Additionally, the modular structure of the inground LED light can allow for upgrade/renewal of associated electronics with only minor disassembly.

Moreover, embodiments of the present disclosure can provide increased service life for inground modules and/or LEDs in use by superior/improved thermal management, e.g., by the selection and use of thermally conducting materials such as bronze bushings or thermally conductive greaser, and/or the presence of an annular gap (doughnut) between the outer housing and the surrounding concrete/cement, thus providing a desired space/volume for air floor (and convective cooling).

Other features and advantages of the present disclosure will be understood upon reading and understanding the detailed description of exemplary embodiments, described herein, in conjunction with reference to the drawings.

BRIEF DESCRIPTION OF DRAWINGS

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

DETAILED DESCRIPTION

Embodiments of the present disclosure include lighting modules that can include multiple LEDs in a sealed housing suitable for use in inground applications. The lighting assemblies can be aimed by external adjustment devices/features/means without the need to open the sealed lighting module. The lighting modules additionally are optimized for thermal management of heat produced from the LEDs and related structure(s). For example, by use of heat conducting materials, heat from the LEDs and/or LED mounting assembly can be transferred to the outside air while the module is tilted, e.g., up to 25 degrees, or more, from vertical. The modular structure of the inground LED light assemblies can allow for upgrade/renewal of associated electronics with only minor disassembly. Moreover, the thermal dissipation/management afforded by the designs of embodiments can allow for an increase of the LED useful service life.

Embodiments of the present disclosure, e.g., inground LED lights and lighting modules, can be used to illuminate a desired area, e.g., including but not limited to, structures such as buildings, signs, landscape materials, flag poles, interior architectural features, product displays, automobiles, etc., and the like. Embodiments of an inground LED light (product) can be pre-cast in concrete, or directly placed in soil, etc. An outer (e.g., rough-in) housing section/portion of the light assemblies can be installed and connected to a conduit system and appropriate power supply/cables, e.g., one with 120 V power of suitable current.

Figure 1:
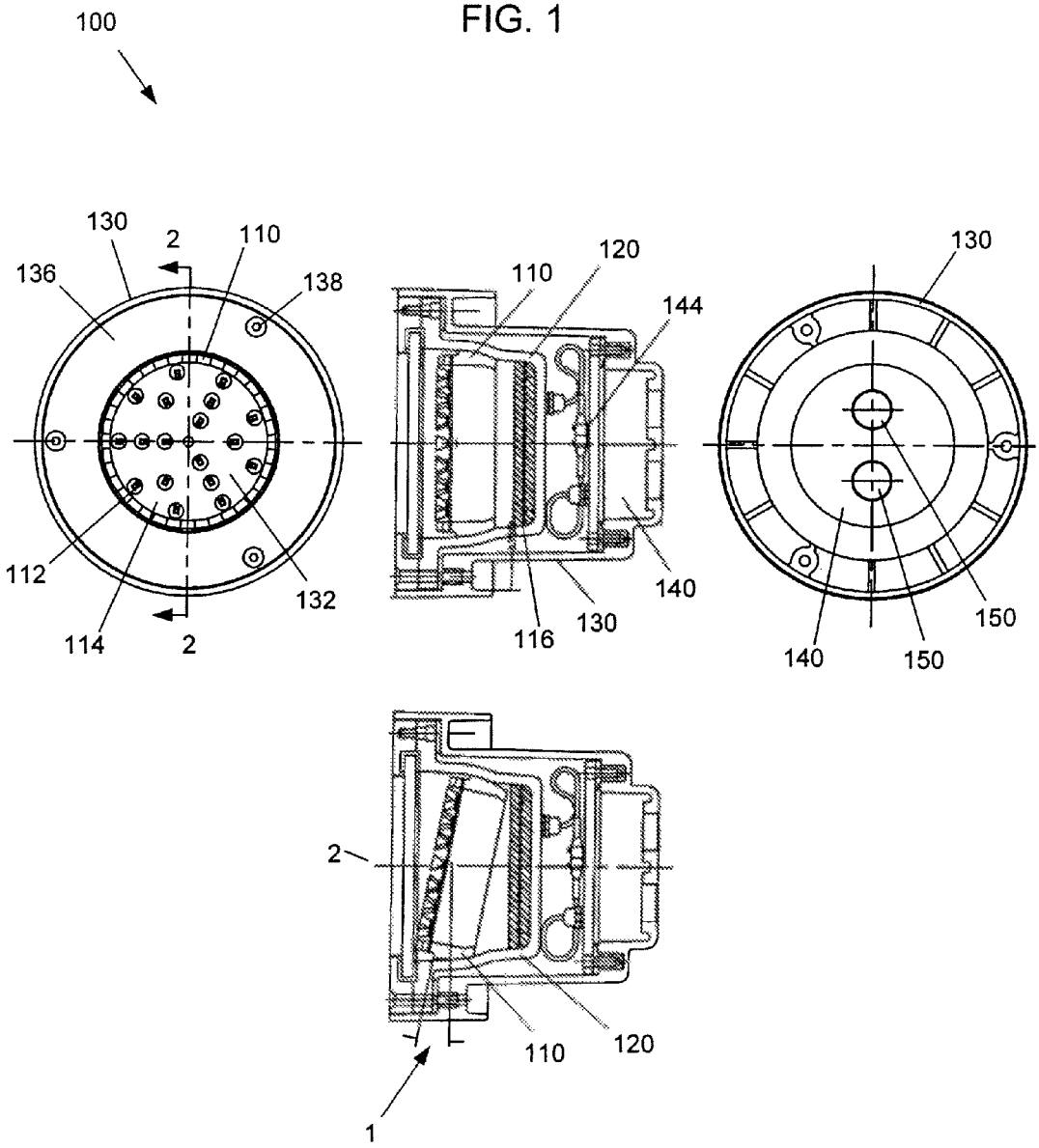
FIG. 1 depicts various views of an inground LED light, in accordance with exemplary embodiments of the present disclosure.

FIG. 1 includes FIGS. 1A-1D, which depict top, first section, bottom and second section views, respectively, of an inground LED light assembly 100, in accordance with exemplary embodiments of the present disclosure.

Referring to FIG. 1A, the light assembly 100 includes a support 110 on which a plurality of LEDs 112 are positioned on a support surface 114 (e.g., a printed circuit board). The support 110 can be received by a first (inner) housing 120 in such a way that the support 110 can be moved to reorient the optical output from the LEDs 112. As shown the interior surface of housing 120 can have a partially spherical (curved) portion that can mate with a corresponding spherical (curved) portion of the support 110. The curved portion of the first housing has an upper end and a lower end. The lower end is located radially inward of the upper end such that the curved portion of the first housing opens upward.

As shown in FIG. 1B, which shows a section view along cutting plane 1-1 in FIG. 1A, the inner housing 120 can be positioned within a second (outer) housing 130. A driver and/or power supply (driver/power supply) 116 can be positioned within the first housing 120. A lens 132 can be held by a lens frame 136, which itself can be held within the second housing 130, e.g., by suitable fasteners including but not limited to screws 138 as shown. The lens 132 encloses the support module 110 within the first housing 120 such that the curved portion of the first housing 120 opens upward toward the lens 132. Also, within the second housing a junction box 140 can be present and connected to the driver/power supply 116 of the first housing 120 by suitable wiring and connector 144.

FIG. 1C depicts a bottom view of the light assembly 100, with the second housing 130, area of the junction box 140 and apertures 150 for electrical connections shown.

FIG. 1D depicts a cross section view similar to FIG. 1B in which support 110 is shown oriented (e.g., aimed) in a different direction than as shown for FIG. 1B. In the view, the curved (e.g., spherical) outer surface of the support 110 is shown as remaining in contact with the curved (e.g., spherical) surface of the inner housing 120, while the direction of the optical output (optical axis) of the LEDs 112 are directed at an angle 1 from the longitudinal axis 2 of the light assembly 100. To facilitate optimal heat transfer characteristics, thermally conductive grease may be used between the spherical surface of the support 110 and the corresponding spherical surface of the first (inner) housing 120. As shown, in FIG. 1, the driver/power supply 116 (which can be encapsulated in epoxy or other materials as desired) can be located as desired in the assembly, e.g., adjacent to a wall of the inner housing 120. It should be noted that the driver/power supply 116 can be implemented on a two-sided circuit board with alternate circuits/features selectable on each of the two sides. Such two-sided functionality can allow the same driver/power supply 116 board to be used for multiple applications (potentially reducing manufacturing costs). The driver/power supply 116 can be placed in other locations, as for example the embodiment shown and described for FIG. 2.

Figures 2, 2A, 2B, 2C, 2D, 2E, 2F:
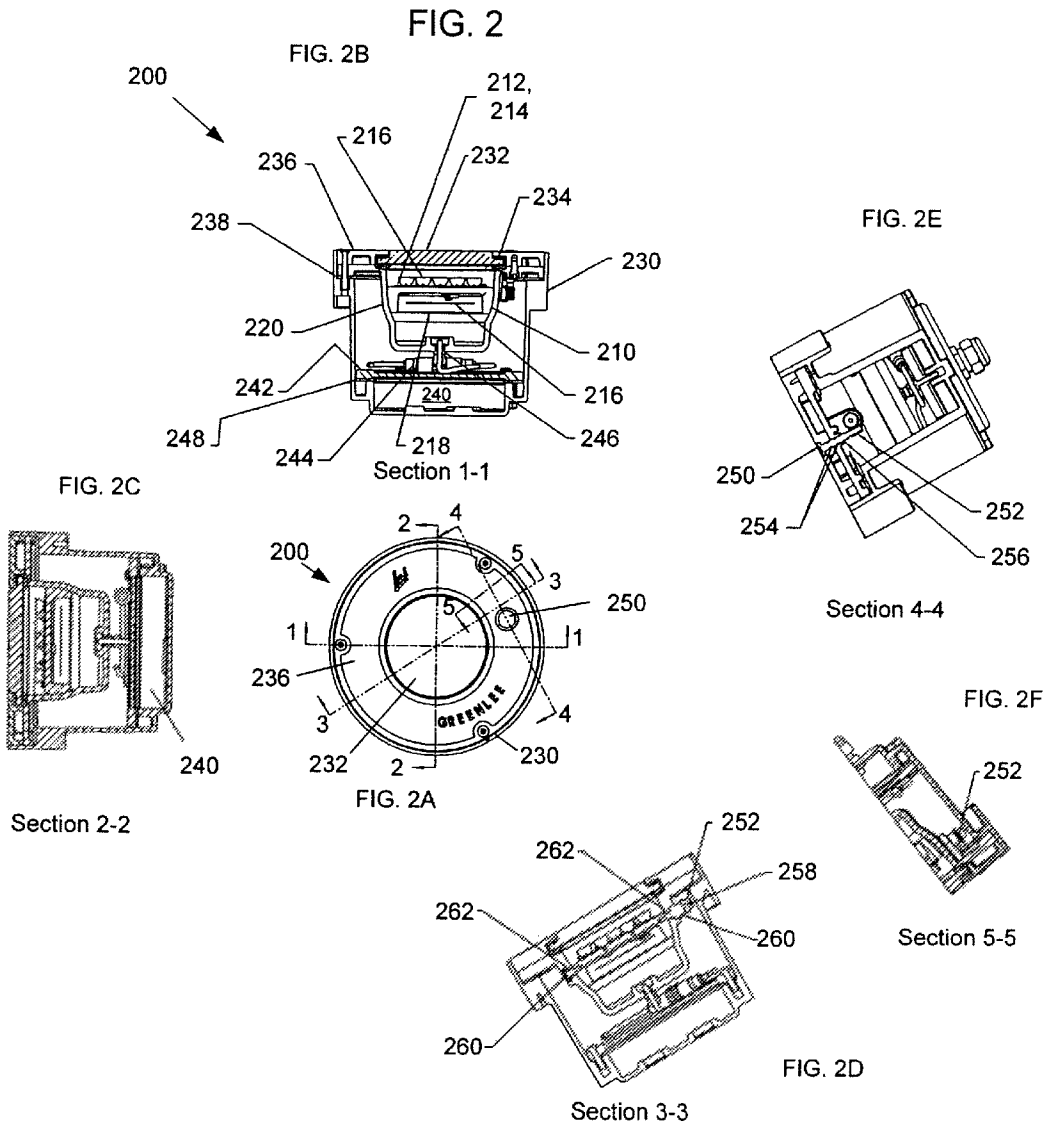
FIG. 2 includes FIGS. 2A-2F, which depict a top view and various cross section views, respectively, of an exemplary embodiment of the present disclosure; and While certain embodiments depicted in the drawings, one skilled in the art will appreciate that the embodiments depicted are illustrative and that variations of those shown, as well as other embodiments described herein, may be envisioned and practiced within the scope of the present disclosure.

FIG. 2 includes FIGS. 2A-2F, which depict a top view and various cross section views, respectively, of an exemplary embodiment of a lighting assembly (or device) 200 according to the present disclosure.

FIG. 2A depicts a top view of an inground light assembly 200. In the top view shown, a housing 230 receives a lens frame 234 that holds a lens 232. The lens functions to pass light from a number of light sources (e.g., LEDs) located within the device 200. As will be described in greater detail below, the light sources (not shown in FIG. 2A) can be supported on a support (module) that is held by another housing in such a way that the orientation of the support is adjustable (or aimable) by an adjustment assembly (or equivalently, a means for adjusting). A representative aiming (orientation) adjustment screw 250 is shown in FIG. 2A.

FIG. 2B depicts a cross section view of light assembly 200 along section line 1-1. Support 210 is configured and arranged to support one or more LEDs 212 on a supporting surface (e.g., printed circuit board) 214. Corresponding optics/optical elements 216 can be present. The support 210 (alternatively called "support module" 210) can be received by a first (inner) housing 220 in such a way that the support 210 can be moved to reorient the optical output from the LEDs 212. As shown the interior surface of housing 220 can have a partially spherical (curved) portion that can mate with a corresponding outer spherical (curved) portion of the support 210. An adjustment assembly/means (e.g., as shown in FIG. 2E) can be present to reorient the support and LEDs without the need of disassembly of the light assembly 200. As with the embodiment of FIG. 1, to facilitate optimal heat transfer characteristics, thermally conductive grease may be used between the spherical surface of the support 210 and the corresponding spherical surface of the first (inner) housing 220.

FIG. 2C depicts a cross section view of light assembly 200 along section line 2-2. The view in FIG. 2C is normal to the view in FIG. 2B.

FIG. 2D depicts a cross section view of light assembly 200 along section line 3-3, in which the section details of an adjustment assembly/means are visible. Included are an aiming adjustment screw 250, wormgear 252, and wormgear retainer pin 258. Pivots (e.g., pivot screws) 260 are shown, which allow the support module 210 to rotate about an axis (between the two screws). In alternate embodiments, the support module 210 can be aimed over a solid angle for increased illumination area coverage; for such, solid angle adjustment, the inner housing 220 can be rotatable (about the longitudinal axis of the outer housing). Alternately, the support module can be rotatable (about the longitudinal axis of the outer housing) in which can an alternate adjustment means/assembly would be required. In exemplary embodiments, a second pair of pivot screws configured with an intermediate housing or housing portion between the inner housing 220 and outer housing 230 could be utilized so as to provide a functional gimbal for aiming the support module (with the light optical axis) over a solid angle. The intermediate housing could have an inner and outer curved (e.g., spherical surface to mate with the corresponding surfaces of the inner 220 and outer 230 housings.

FIG. 2E depicts a cross section view of light assembly 200 along section line 4-4. As shown, the aiming adjustment screw 250 can be exposed to an outer surface of the second housing 230 so that the orientation of the support module and LEDs can be adjusted without requiring disassembly of the assembly 200. The adjustment screw 250 (e.g., made from 304 stainless steel) can be knurled to retain a wormgear 252. O-rings 254 and a retaining ring 256 can be present, as shown.

FIG. 2F depicts a cross section view of light assembly 200 along section line 5-5. FIG. 2F shows the wormgear 252 from another perspective.

In exemplary embodiments, as indicated in FIG. 2, a housing (a/k/a a finishing section) of the lighting housing, containing a LED support (e.g., which may be referred to as a "SSL19" in reference to solid state lighting employing 19 LEDs), can be connected via a suitable connection, e.g., IP67 submersible connector and placed into an outer housing (rough-in housing, or "RIH") as pre-cast in concrete. Suitable connectors of desired number and type, e.g., three screws, can connect the outer housing to the RIH. The LEDs of the unit/assembly can then be aimed in a desired orientation/direction, e.g., by rotating an adjustment screw/knob with a suitable tool such as a screw driver or Allen wrench, or manually.

In exemplary embodiments of device 200, the LEDs can be Nichia NS6 white LEDs (see, e.g., FIG. 3) configured to nominally operate on 350 mA, the lens frame can be made of bronze alloy, the optics can be made of molded acrylic, the lens can be made of low-iron tempered glass, the lens gasket can be made of molded silicon, the second (outer) housing can be made of SMC polyester composite, the support 210 can be made of bronze alloy (e.g., with 5-15% copper), the seal 246 can be a gland type cord seal, the driver/power supply can be encapsulate din an epoxy encapsulant, the gasket 248 can be made from die cut silicon, the cover for the junction box can be made of RIH SMC polyester composite, the inner housing 220 can be made of bronze alloy, and gasket 238 can be made of die cut silicon. It should be noted that all materials indicated for the drawings are examples that may be used for exemplary embodiments; other materials may be used within the scope of the present disclosure.

With continued reference to FIG. 2, cross section views of the shape of a number of optics/optical element 216 of a suitable material, e.g., clear acrylic or PMMA, are shown in FIGS. 2B-2D. One skilled in the art will appreciate, however, that other shapes and configurations of the optics 216 may also (or in the alternative) be used, e.g., any type of suitable cross section, such as spherical, hyperbolic, parabolic, combinations of such, etc.; moreover, reflective elements could also (or in the alternative) be used for guiding light away from the one or more LEDs 212.

An exemplary embodiment of an optic (optical element) used for dispersion/light shaping of LEDs (e.g., as shown by 216 in FIG. 2) in accordance with the present disclosure may be referred to herein by the part number "SAC-002," though this is merely for convenience. This exemplary embodiment comprised an SAC-002 molded with acrylite d120 from DMB Relfex Lighting Solutions. Where used with a Nichia NS6 white LED with half angle divergence of 14°, PEAK curve type, PMMA lens material and an operating temperature of −40° C. to +90° C., the SAC-002 produced a half angle divergence efficiency of 39% and a collection efficiency of 91%; an output distribution provided 8.9× multiplicator rate and had a maximum intensity of 188 Cd; and provided the following illuminance values: 179 Lux at 1.0 meters; 45 Lux at 2.0 meters; 20 Lux at 3.0 meters.

Accordingly, embodiments of the present disclosure can provide one or more advantages relative to prior inground lighting apparatus and techniques. For example, embodiments can provide equivalent performance to prior 39 Watt metal halide lamps in 15 fixed spot or 60 fixed flood distribution options. Embodiments may provide for 180 rotation of beam and/or 0-15 tilt angle from vertical.

Further, exemplary embodiments can provide equivalent performance to 100 W Metal Halide lamps with 10-25 variable spot, 30-60 variable flood, asymmetric wall wash ("AWW"), and/or superior wall wash ("SPW") distribution options. Exemplary embodiments may provide up to 360 rotation of beam (or multiple rotations), and/or 0-25 (or more) tilt angle from vertical. Furthermore, tilt and rotation can be adjustable without the need to open any housing. And, embodiments can offer the ability to aim the LEDs (and resulting beam) without a main power supply being on. Any suitable LEDs can be used for embodiments according to the present disclosure. Such can include, but are not limited to, LEDs have a color temperature over a range from about 3000 to 6000 degrees K, e.g., 5000 degrees K. Each electrical component/part of devices/assemblies described herein can be water-proofed or sealed to prevent damage by water/moisture or other liquids.

While certain embodiments have been described herein, it will be understood by one skilled in the art that the methods, systems, and apparatus of the present disclosure may be embodied in other specific forms without departing from the spirit thereof.

Accordingly, the embodiments described herein, and as claimed in the attached claims, are to be considered in all respects as illustrative of the present disclosure and not restrictive.

What is claimed is:

1. A lighting device installed inground comprising:

a support module supporting a plurality of LEDs and having an outer perimeter defining a curved portion;

a first housing having an inner surface defining a curved portion configured and arranged to receive the curved portion of the support module and hold the support module in a desired orientation, the curved portion of the first housing having an upper end and a lower end and the lower end is located radially inward of the upper end such that the curved portion of first housing opens upward;

a lens enclosing the support module within the first housing such that the curved portion of the first housing opens upward toward the lens;

wherein the support module outer perimeter curved portion is configured and arranged to remain in contact with the first housing inner surface curved portion at any of a plurality of desired orientations.

2. The device of claim 1, further comprising a means for adjusting the support module orientation within the first housing.

3. The device of claim 2, wherein the means for adjusting comprises a worm gear and an adjustment screw.

4. The device of claim 1, wherein the support module comprises a spherical outer surface and the first housing comprises a spherical inner surface configured and arranged to receive the spherical outer surface of the support module when the support module is oriented in any one of a plurality of orientations.

5. The device of claim 1, further comprising a second housing, with a longitudinal axis, configured and arranged to receive the first housing.

6. The device of claim 5 the second housing configured to be placed inground.

7. The device of claim 5, wherein the support module comprises a spherical outer surface and the first housing comprises a spherical inner surface configured and arranged to receive the spherical outer surface of the support module when the support module is oriented in any one of a plurality of orientations.

8. The device of claim 7, further comprising a pair of pivot screws between the first housing and the support module that are configured and arranged to allow the support module to pivot within the first housing, wherein the pivot screws define a first pivot axis of the support module.

9. The device of claim 7, wherein the support module is tilted within plus or minus about 25 degrees from vertical.

10. The device of claim 9, wherein the support module is tilted within plus or minus about 15 degrees from vertical.

11. The device of claim 7, wherein a light direction axis of the support module is within a solid angle with the longitudinal axis of the second housing of about 25 degrees.

12. The device of claim 11, wherein a light direction axis of the support module is within a solid angle with the longitudinal axis of the second housing of about 25 degrees.

13. The device of claim 11, further comprising an intermediate housing and a second pair of pivot screws defining a second pivot axis for the support module, wherein the second pivot axis is about normal to the first pivot axis, wherein the light direction axis is aimable over a solid angle.

14. The device of claim 11, wherein the first housing is rotatable within the second housing, wherein the first pivot axis rotates with respect to the longitudinal axis.

15. The device of claim 1, further comprising a lens secured to the first housing enclosing the support module within the first housing.

* * * * *